US005230535A

United States Patent [19]

Figlenski

[11] Patent Number: 5,230,535

[45] Date of Patent: Jul. 27, 1993

[54] COMBINED TYPING BOOK AND PAPER SUPPORT STAND

[76] Inventor: William F. Figlenski, 153 Nolan, Okanogan, Wash. 98840

[21] Appl. No.: 830,072

[22] Filed: Feb. 3, 1992

[51] Int. Cl.[5] ..... B42D 3/00

[52] U.S. Cl. ..... 281/45; 248/441.1; 248/451

[58] Field of Search ..... 281/42, 44, 45, 51; 248/441.1, 445, 446, 450, 451, 452, 453, 465.1, 459

[56] References Cited

U.S. PATENT DOCUMENTS

| | | | |
|---|---|---|---|
| D. 39,646 | 10/1908 | Willson et al. . | |
| D. 169,903 | 6/1953 | Hawkinson | D74/1 |
| D. 214,142 | 5/1969 | Dolgorukov | D74/1 |
| D. 215,767 | 10/1969 | Pagano | D74/1 |
| D. 292,249 | 10/1987 | Stade | D6/406 |
| 402,518 | 4/1889 | Fowler . | |
| 502,574 | 8/1893 | Munson et al. . | |
| 575,928 | 1/1897 | Ives . | |
| 738,763 | 9/1903 | Boden . | |
| 809,310 | 1/1906 | Long . | |
| 839,643 | 12/1906 | Richardson . | |
| 844,901 | 2/1907 | Smith . | |
| 1,086,906 | 2/1914 | Felten . | |
| 1,169,869 | 2/1916 | Richards . | |
| 1,194,016 | 8/1916 | Harford . | |
| 1,812,318 | 6/1931 | Bower . | |
| 1,971,600 | 8/1934 | Denio | 120/28 |
| 3,041,774 | 7/1962 | Walker | 45/64 |
| 3,174,626 | 3/1965 | West | 211/42 |
| 3,836,108 | 9/1974 | Surette | 248/452 |
| 3,945,598 | 3/1976 | Bell | 248/441 D |
| 3,981,522 | 9/1976 | Bloom | 281/34 |
| 4,296,946 | 10/1981 | Larre et al. | 281/45 |
| 4,555,128 | 11/1985 | White et al. | 281/45 |
| 4,880,327 | 11/1989 | Sanabria | 402/73 |
| 4,903,932 | 2/1990 | Stewart | 248/444 |

FOREIGN PATENT DOCUMENTS

| | | |
|---|---|---|
| 26976 | of 1910 | United Kingdom . |
| 262274 | 12/1926 | United Kingdom . |
| 672300 | 5/1952 | United Kingdom . |

*Primary Examiner*—Timothy V. Eley
*Assistant Examiner*—Willmon Fridie, Jr.
*Attorney, Agent, or Firm*—Wells, St. John, Roberts, Gregory & Matkin

[57] ABSTRACT

A book support stand for top bound books, particularly typing books. The stand includes a base having a first panel. A first edge stop extends upwardly from the first panel to hold the front cover of a book at the distal edge. A second edge stop extends upwardly to hold the rear cover. The second edge stop can be formed by an upstanding second panel. The support also includes a retainer which is most preferably in the form of an oblong ring which is slid over the covers and positioned at one of the hinges of the book covers. The base is advantageously constructed to allow a second mode of operation wherein loose papers can be supported in an upstanding position for viewing by a typist.

23 Claims, 8 Drawing Sheets

COMBINED TYPING BOOK AND PAPER SUPPORT STAND

TECHNICAL FIELD

The technical field of this invention is book support stands for top bound books, such as typing books. More particularly, the invention relates to combined typing book and paper support stands for supporting typing and other double hinged, top bound books, and loose papers.

BACKGROUND OF THE INVENTION

Typical typing books are provided in a form having a large number of pages which are bound along the top. The typical typing book covers are relatively strong and joined to the top spine of the book using a double hinged binding design. This top binding construction allows the covers to be folded together in a relationship wherein the outer surfaces of the front and rear covers are face-to-face.

This top bound, double hinge format for typing books has associated problems concerning the proper support of the books for use by typists. Typists prefer to have the pages facing them in an upstanding position at an angle closer to vertical than horizontal. However, the pages of typing books are difficult to manage and have a tendency to flip forwardly or backwardly depending upon the relative page number at which the book is opened.

Prior art copy holders for holding loose papers are deficient when used with typing books or other relatively heavy top-bound books. Difficulties associated with such prior paper stands include: their awkwardness or failure to maintain a book in a desired open position; pages flipping over; text near the curve of the binding being unreadable; and general instability when loaded with a book.

The need for a suitable typing book stand has been long felt in the art. For many years typing teachers and students have suffered with the deficiencies of the prior art stands or suffered with the awkwardness of typing books without a stand. It is also desirable to have a stand which not only works with typing books but also serves to support loose papers. Although there are many types of typing-related paper stands, none of these adequately support a typing book and solve the problem of undesired and inadvertent page flipping. This inadvertent flipping of typing book pages is a problem well-known to any student who has participated in a typing class.

There has been a long-felt need for a stable and reliable apparatus for holding typing books in an open position without inadvertent page flipping. The current invention addresses this need and provides a combined book and loose paper support stand.

BRIEF DESCRIPTION OF THE DRAWINGS

One or more preferred forms of the invention are described herein with reference to the accompanying drawings. The drawings are briefly described below.

FIGS. 9 and 10 show the cover retainer being installed upon the front and back covers of a typing book in preparation for support of the typing book on the stand.

FIG. 13 is a right side elevational view of the stand of FIG. 12.

FIG. 14 is a rear elevational view of the stand of FIG. 12.

DETAILED DESCRIPTION OF THE PREFERRED EMBODIMENTS

Figure 1:
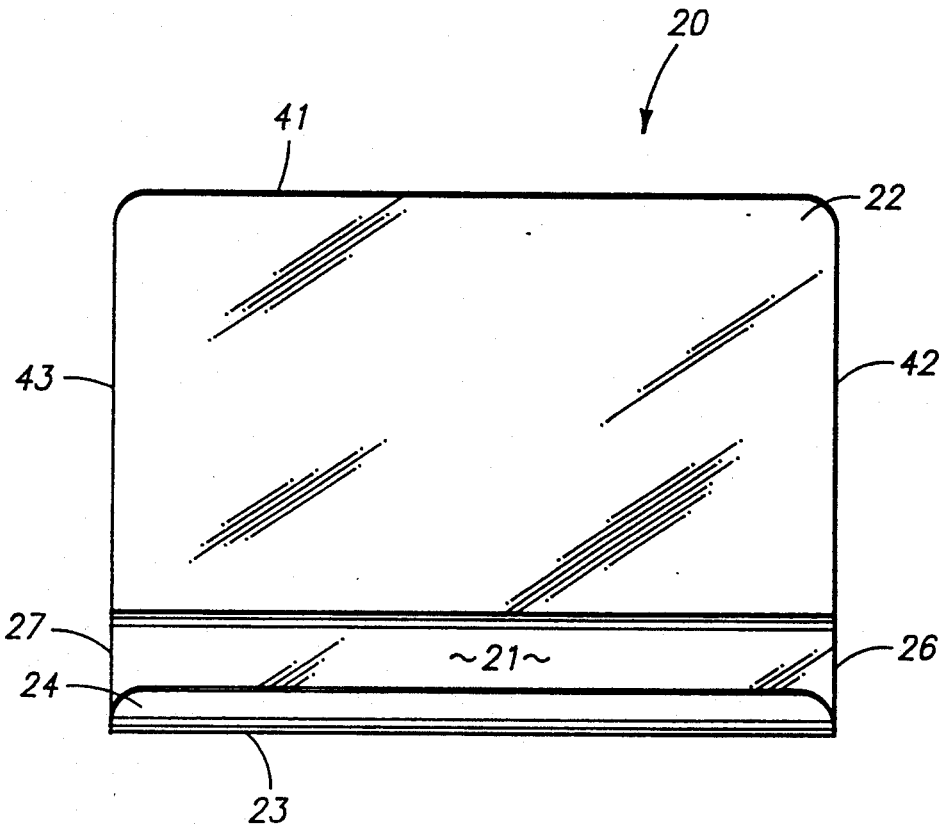
FIG. 1 is a front elevational view of a preferred embodiment of combined typing book support and paper stand base made according to this invention.
Figure 2:
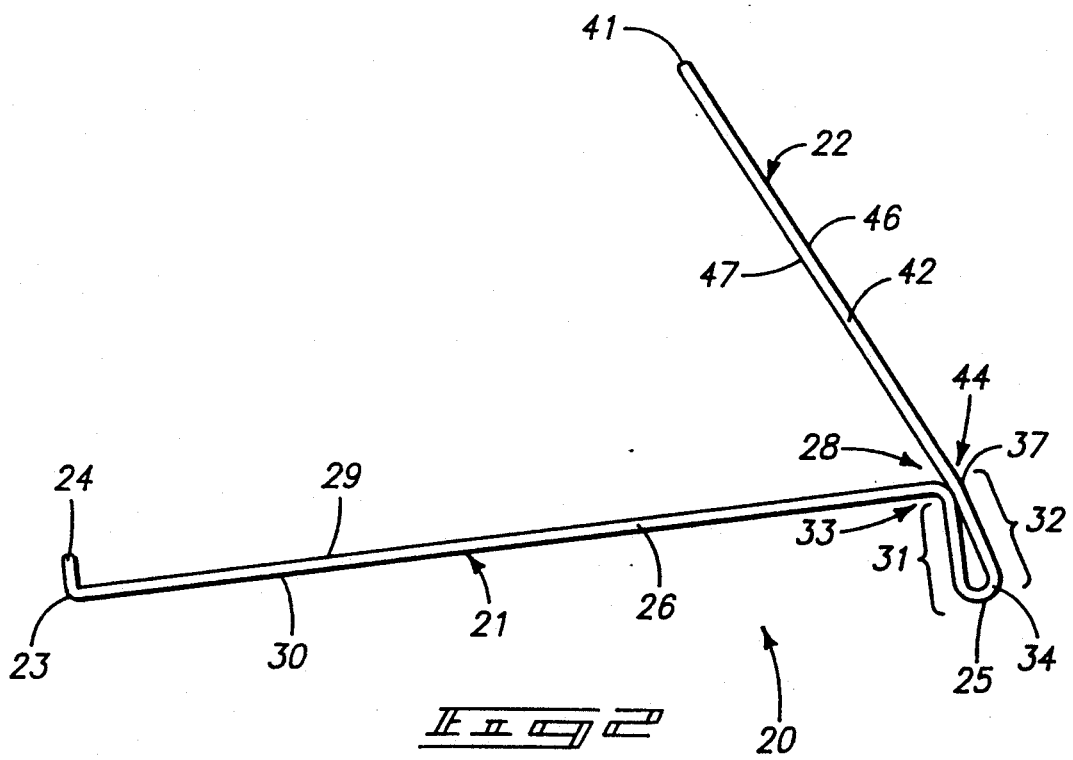
FIG. 2 is a right side elevational view of the stand base of FIG. 1.
Figure 3:
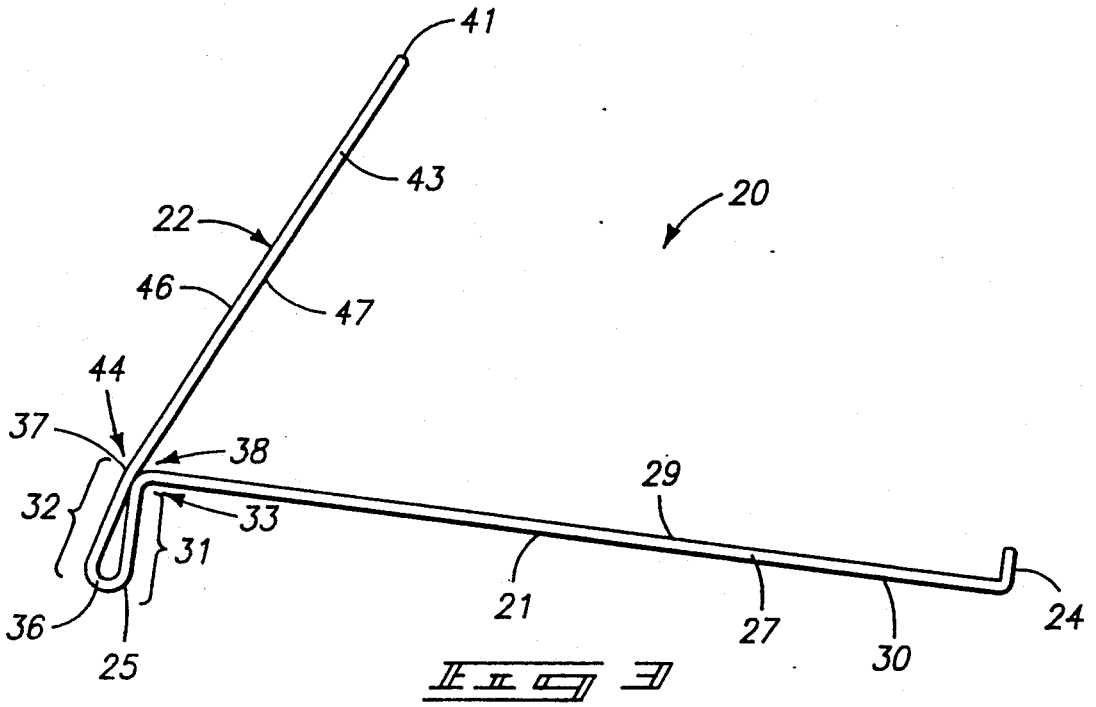
FIG. 3 is a left side elevational view of the stand base of FIG. 1.
Figure 4:
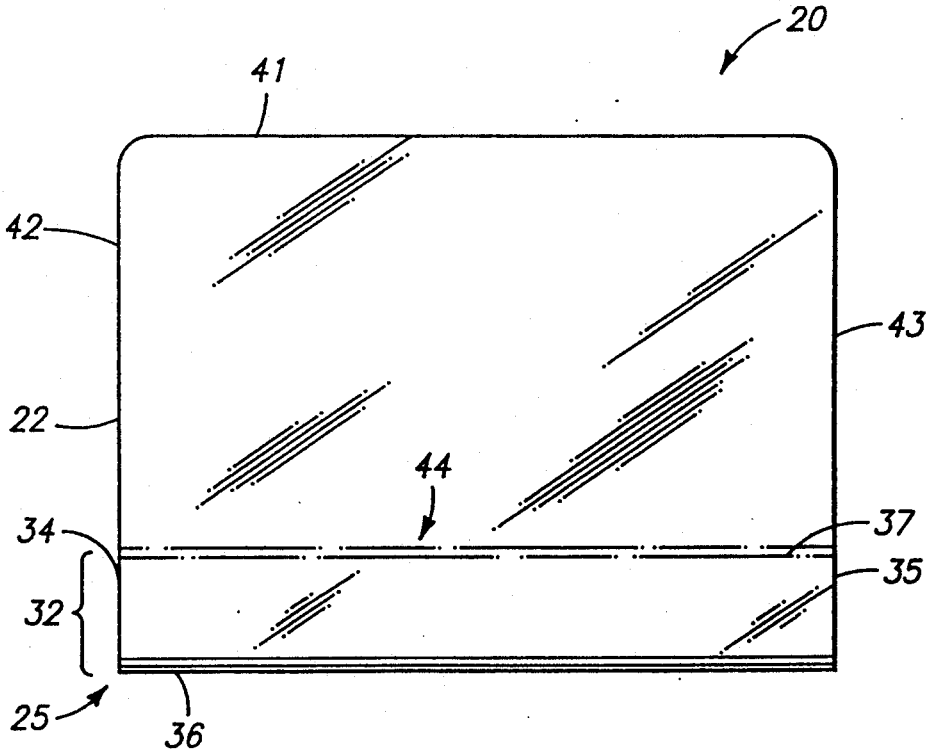
FIG. 4 is a rear elevational view of the stand base of FIG. 1.
Figure 5:
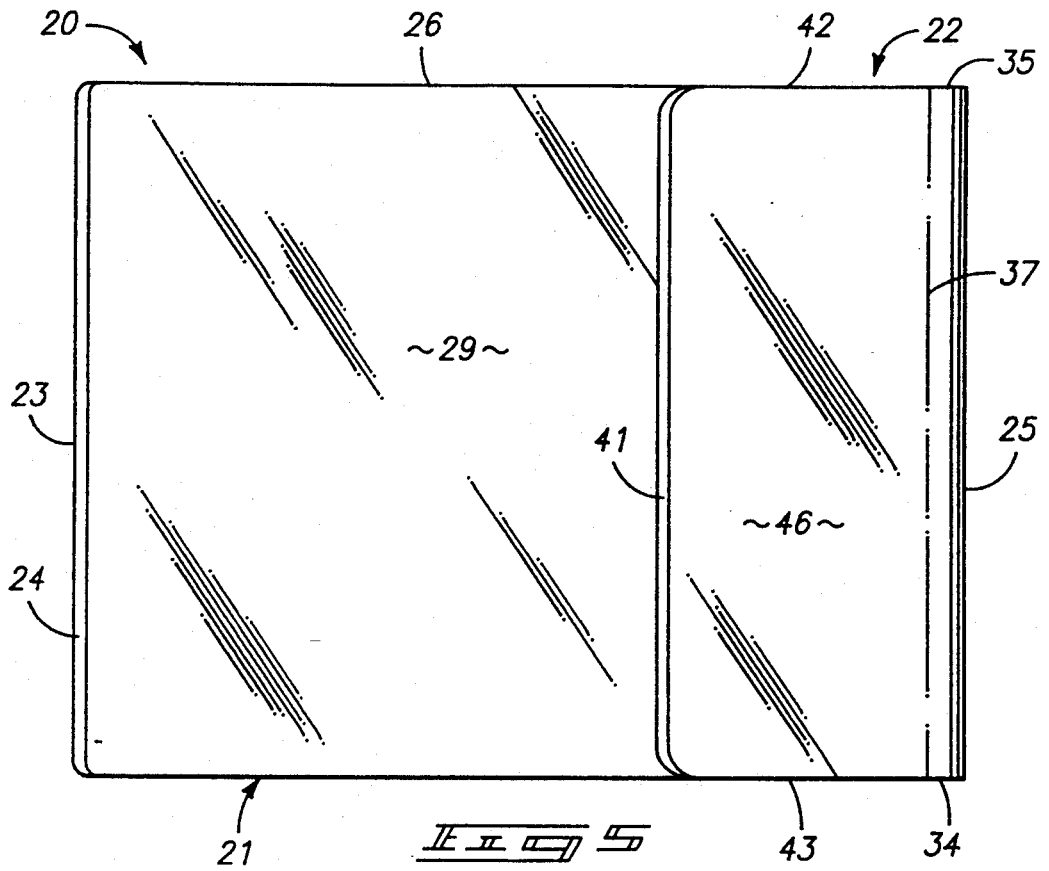
FIG. 5 is a top view of the stand base of FIG. 1.
Figure 6:
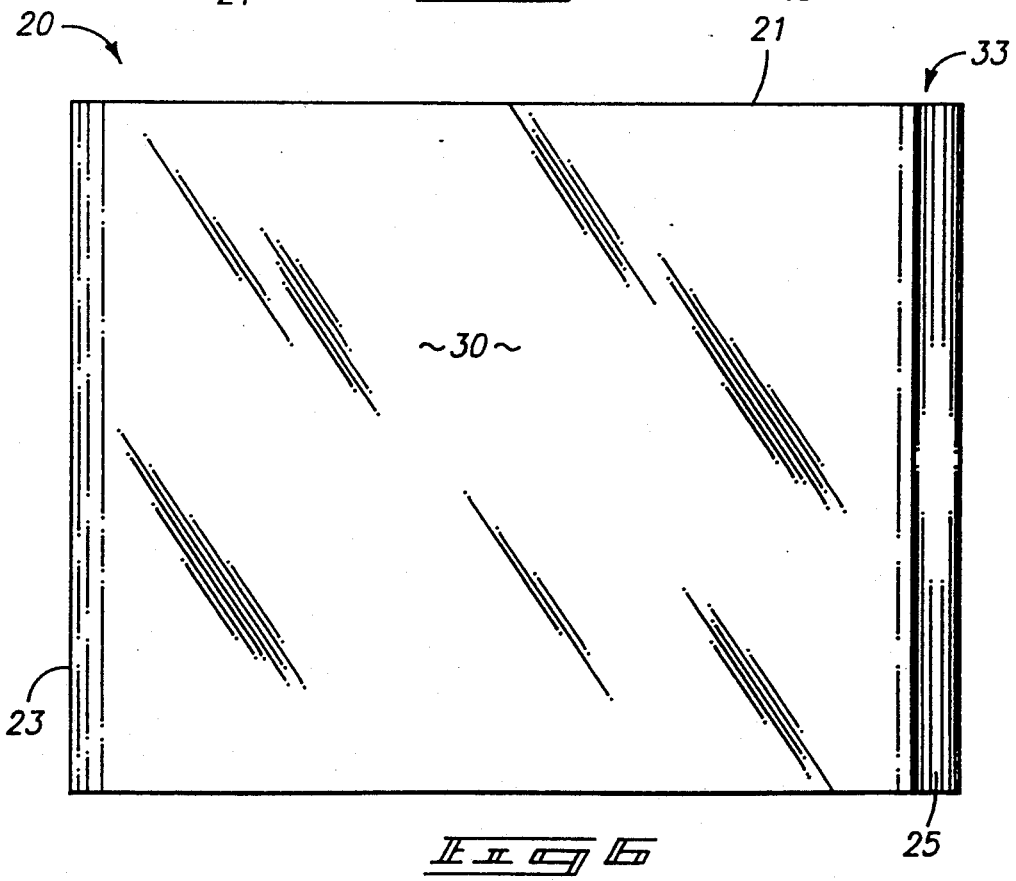
FIG. 6 is a bottom view of the stand base of FIG. 1.

This disclosure of the invention is submitted in furtherance of the constitutional purposes of the U.S. Patent Laws "to promote the progress of science and useful arts" (Article 1, Section 8).

FIGS. 1–6 show a stand base 20 forming a part of the novel combined typing book and paper support stand of this invention. The preferred stand base 20 includes a first panel 21 and a second panel 22. As shown, first panel 21 is in part defined by a first or front edge 23. First edge 23 is preferably provided with a first edge stop 24 which is advantageously formed as a lip which is upturned and transverse to the remaining portions of the first panel.

First panel 21 is additionally defined by complementary side edges 26 and 27. As shown, right side edge 26 is substantially parallel to left side edge 27. First panel 21 is most preferably a planar structure about the same width as a typing book or other top bound book being supported thereon (see FIG. 8). Side edges 26 and 27 extend rearwardly from the distal frontward or first edge 23 to a proximate rearward or second edge 28. First panel 21 has a first or upper side 29 and a second or downward side 30. The first edge 23 and associated first edge stop 24 are preferably approximately parallel to the second edge 28 and associated second edge stop provided by panel 22.

The rear or second edge 28 of panel 21 is advantageously defined by a first panel support feature 25. First panel support feature 25 is an extension which extends transversely outwardly from the rear or second edge 28 of the first panel. The outward and downward transverse extension of support feature 25 supports the rear edge of the first panel above a supporting counter or other surface (not illustrated). The angled and elevated position of first panel 21 is desired when the stand base 20 is used in the book support stand mode of operation.

Support feature 25 is advantageously formed by folding sheet material into a fold or pleat having a first pleat or fold part 31 and a second pleat or fold part 32. The first pleat part is connected to the first panel 21 along a rear first panel bend 33. The second pleat part 32 is connected to second panel 22 along a rear second panel bend 37. The support fixture fold 25 formed by parts 31 and 32 has associated right and left end edges 34 and 35, respectively. The connection of parts 31 and 32 is at a contact ridge 36 which contacts a supporting surface, such as a countertop (not illustrated). The fold also serves as a connection between the first and second panels 21 and 22.

Second panel 22 extends upwardly and transversely relative to first panel 21. Second panel 22 has a first or distal edge 41. Extending inwardly and downwardly from distal edge 41 are the complementary right and left second panel side edges 42 and 43. Side edges 42 and 43 are advantageously spaced and approximately parallel as shown. The second inward or proximate edge 44 of the second panel is defined by rear second panel bend 37. The second panel is preferably planar and has a first or outward face. The second panel advantageously serves as a second edge stop against which a distal edge of a book cover can bear when the invention is used in the book support mode of operation.

The stand base 20 is preferably made by forming sheet acrylic material into the desired shape as indicated. This provides integral connections between the first and second panels using the support feature fold 25. The lip 24 is also advantageously formed from such a single sheet of material and integral with the remaining parts of base 20.

Figure 7:
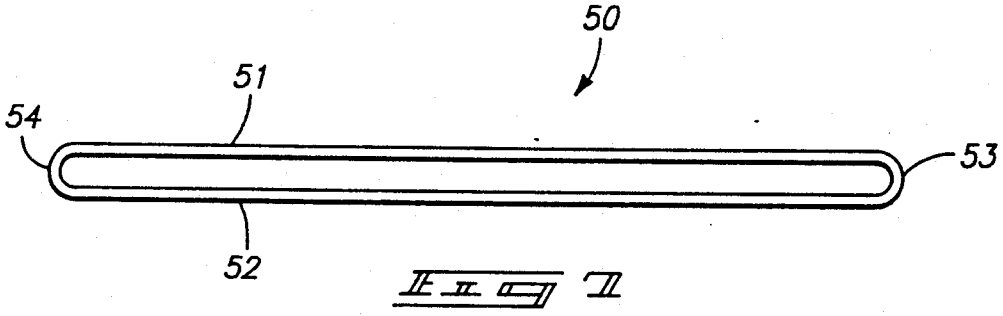
FIG. 7 is a top view of a preferred cover retainer used with the stand base of FIG. 1 to provide a preferred typing book support and paper stand according to this invention.

FIG. 7 shows a preferred cover retainer 50 constructed according to this invention. Cover retainer 50 includes a pair of opposing, elongated longitudinal bars 51 and 52. First longitudinal bar 51 and second longitudinal bar 52 are preferably formed to be the same length and are complementary and parallel as shown. The first and second retainer bars are secured together. This is most preferably accomplished using a pair of complementary end pieces 53 and 54. The end pieces 53 and 54 are preferably formed as semicircular links. Retainer 50 is most preferably formed as an oblong annular ring or loop which is continuous and made of a non-stretchable material. Most preferably it is made of chrome plated brass or other suitable relatively strong and relatively inelastic materials.

Figure 8:
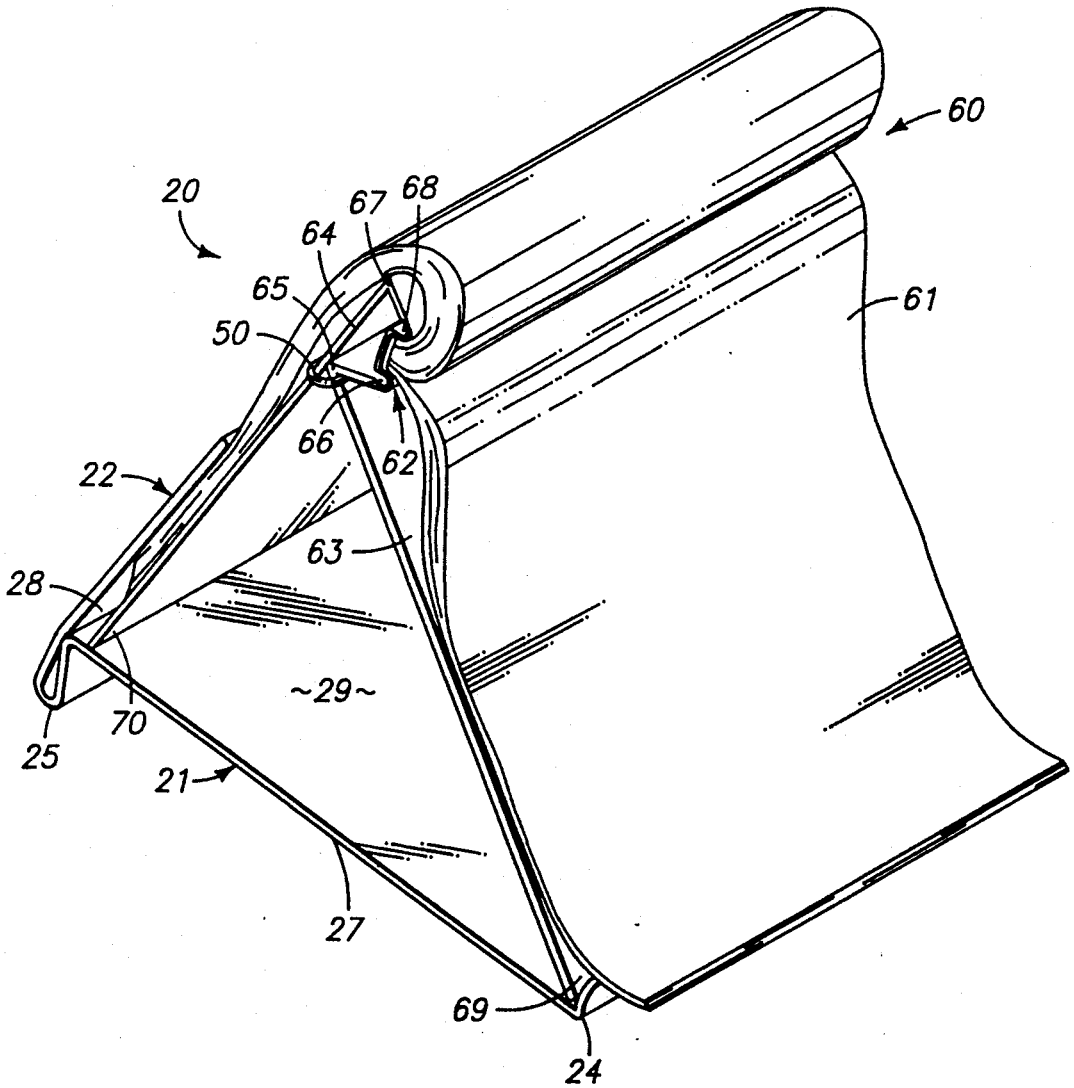
FIG. 8 is a perspective view of the stand base of FIG. 1 showing a typing book held into position on the stand using the retainer of FIG. 7.

FIG. 8 shows the preferred book support stand which incorporates both stand base 20 and cover retainer 50. FIG. 8 shows the stand as used to support a typing book 60. Typing book 60 has a plurality of paper leaves 61 which each have two pages with printed text upon both sides thereof. The book leaves 61 are gathered and bound in a binding 62. The book also has a first cover 63 and second cover 64. The first and second covers are connected by book hinges 65–68 to the spine 69 (see FIG. 9) of the book. As shown, the covers are connected by double hinges which are typical of typing books. First cover 63 has associated first or distal hinge 65 and second or proximate hinge 66. Second cover 64 has associated first or distal hinge 67 and second or proximate hinge 68.

The novel methods of supporting a top bound book according to this invention and the manner of using the book support stand described above will now be considered. The stand base 20 is best used in supporting a typing book by setting it into a book stand mode position, as shown most clearly in FIG. 8. In the book stand mode position, the rear of the stand base contacts a counter or other supporting surface along the support feature ridge 36 of the fold or other support feature 25. The front edge 23 of the stand base first panel 21 also contacts the supporting surface.

Figure 10:
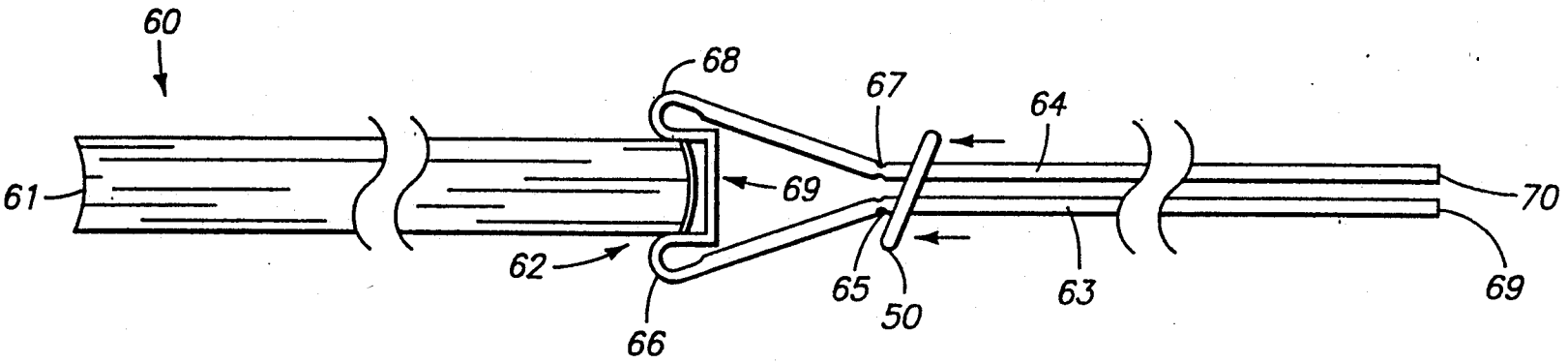

FIGS. 9 and 10 illustrate a preferred manner of accomplishing the step of installing a retainer upon the top bound book 60. When the preferred annular retainer 50 is used, the installing step first preferably includes pivoting or extending the first and second book covers 63 and 64 into extended positions wherein the outer faces of the covers are in face-to-face relationship to achieve a face-to-face cover relationship position. The preferred installation next includes sliding the annular retainer 50 over the book covers while they are in a face-to-face position, as shown in FIGS. 9 and 10. The retainer is preferably slid to a position adjacent to one or both of the first or distal hinges 65 and 67.

The preferred book support method also preferably includes supporting first book cover 63 upon the first panel and against the first edge stop 24. The distal edge 69 of the first book cover bears upon the interim side of the first edge stop formed by lip 24.

The preferred book support method further preferably includes supporting a second book cover upon the first panel along a second edge stop. The distal edge 70 of the second book cover bears upon the first panel and can also bear directly or indirectly against the second edge stop formed by second panel 22. As shown in FIG. 8, the overlying pages have been positioned between the second panel 22 and cover 64. This arrangement can further secure the overlying pages and better prevent inadvertent page flipping.

The methods may also include adjusting to obtain a position for the retainer adjacent to a cover hinge. This position is preferably along a distal cover hinge of the first cover. This provides effective positioning and support for top-bound books.

After book 60 is properly positioned between the front and rear stops, then the typist can select the desired page by turning pages over from the first cover side to overlying positions adjacent the second cover side. For the best viewing of pages near the covers, it may be additionally desirable to secure some or all of the pages lying adjacent the second panel. These pages can be secured by inserting them between the second cover 64 and the second panel 22 as shown in FIG. 8. This provides additional support which prevents pages from inadvertently flipping.

Figure 11:
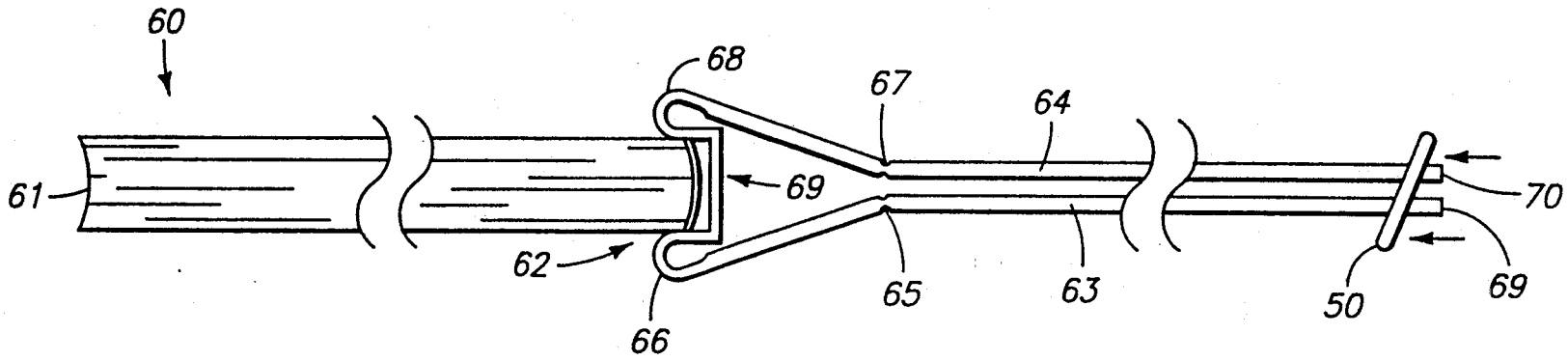
FIG. 11 is a left side elevational view of the stand base of FIG. 1 in an alternative mode of operation holding a loose paper in convenient view for a typist.
Figure 12:
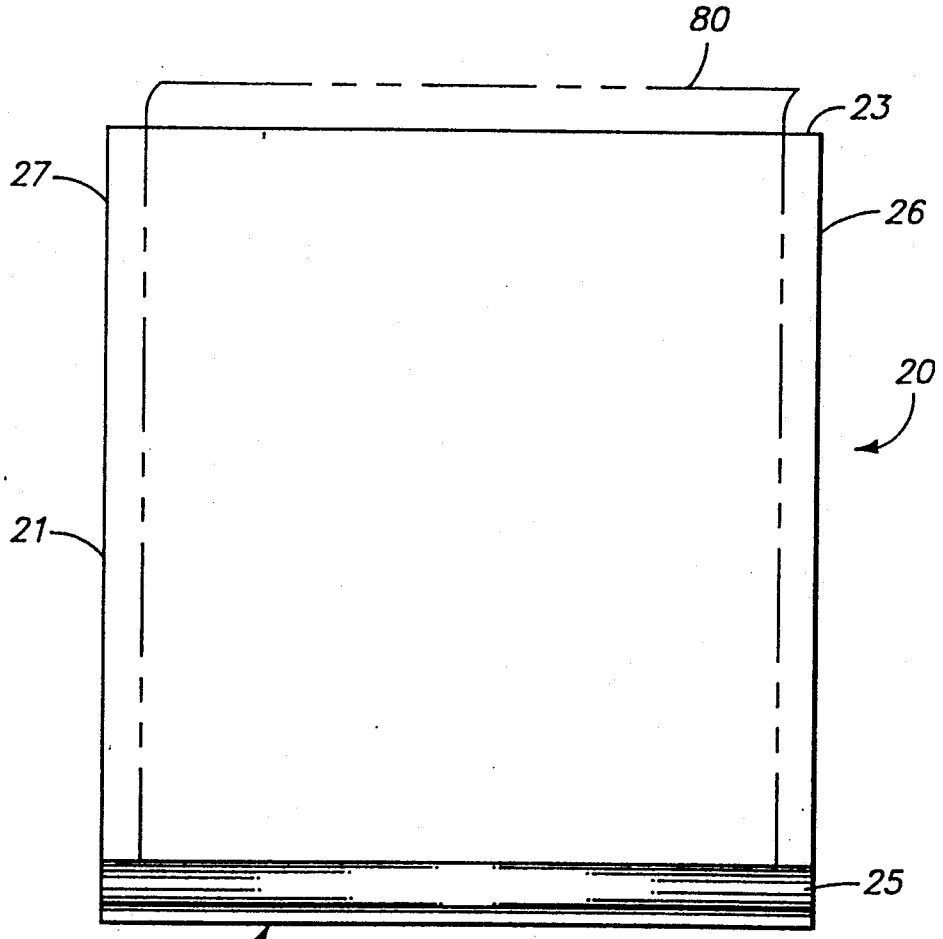
FIG. 12 is a front elevational view of the stand of FIG. 11, also showing the loose paper supported thereon.
Figure 11:
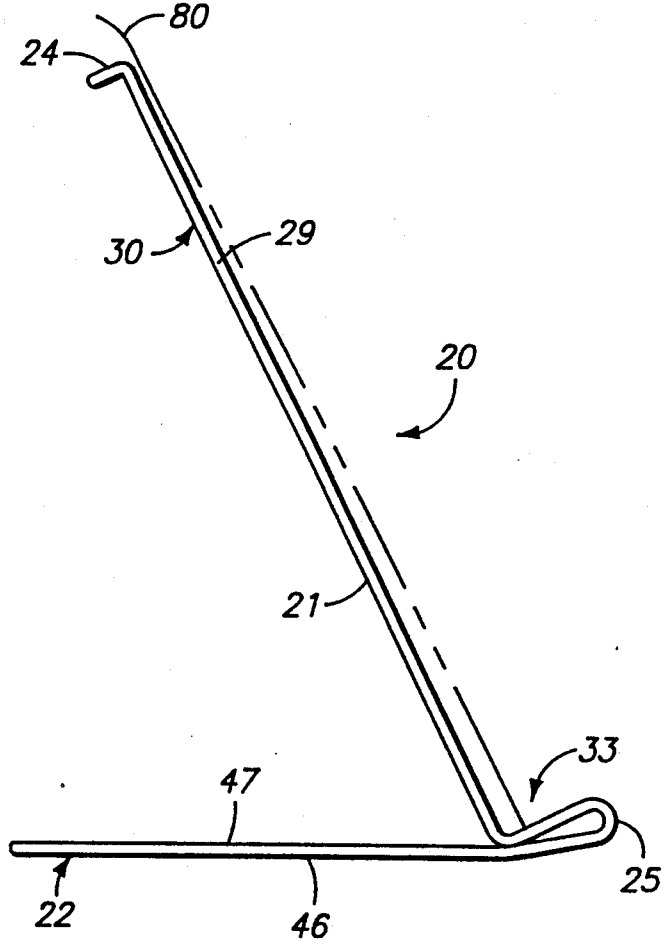
Figure 11:
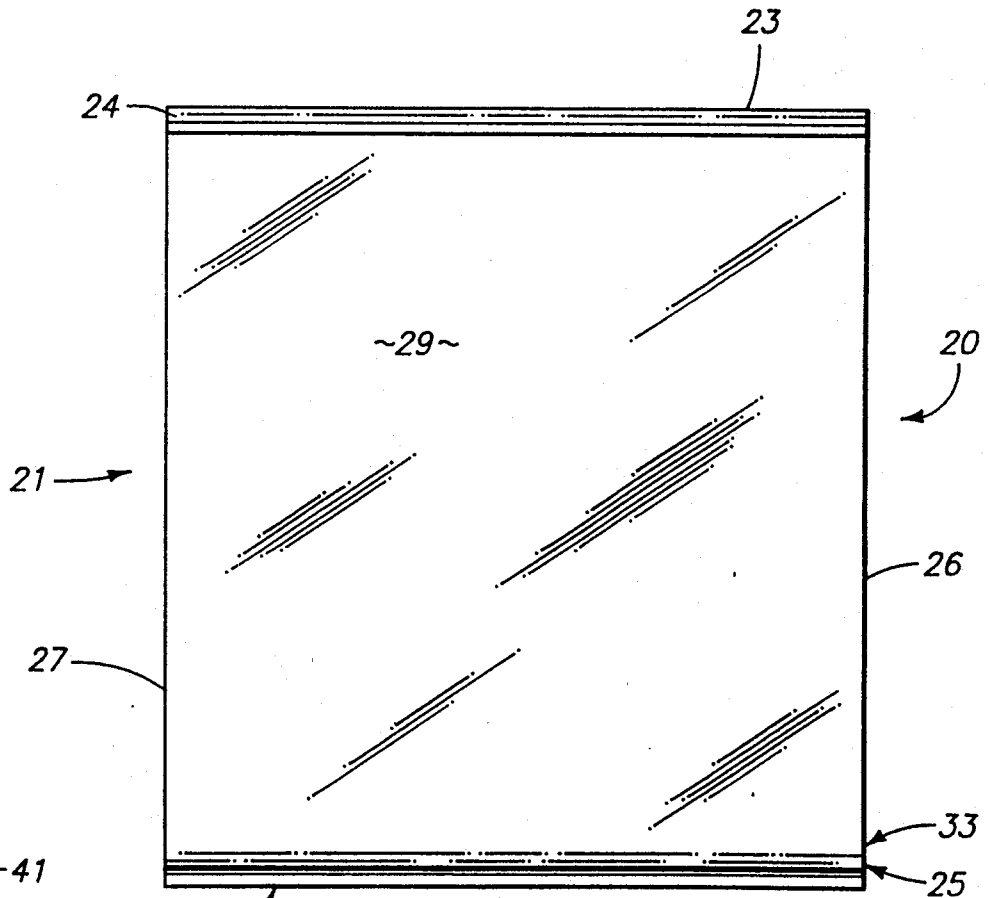
Figure 12:
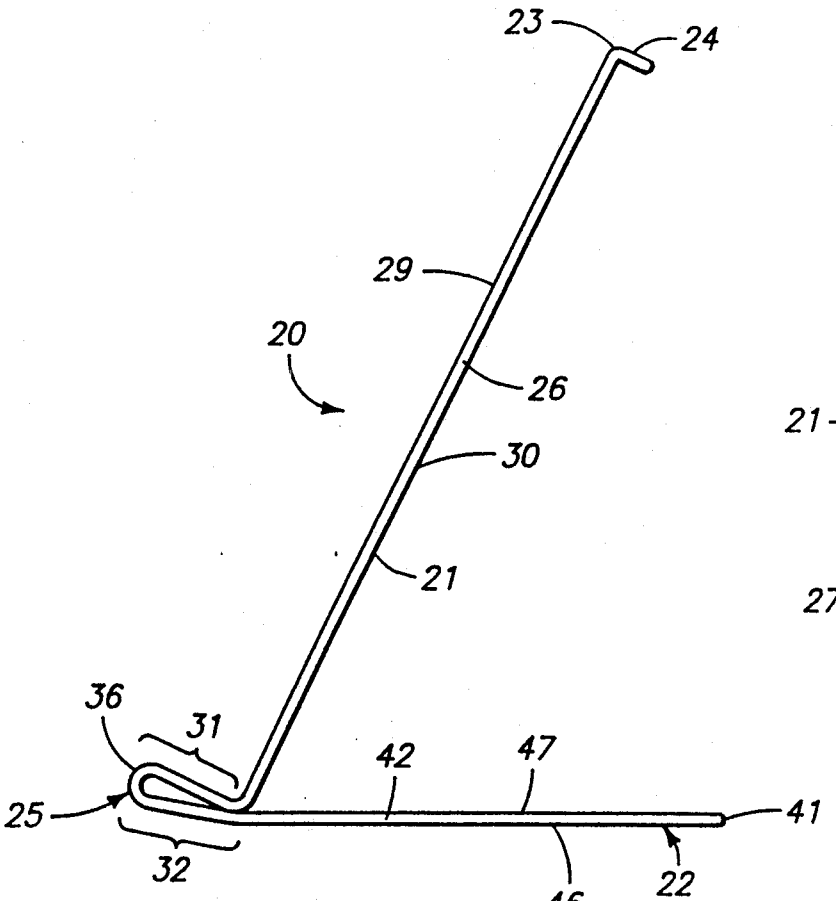
Figure 16:
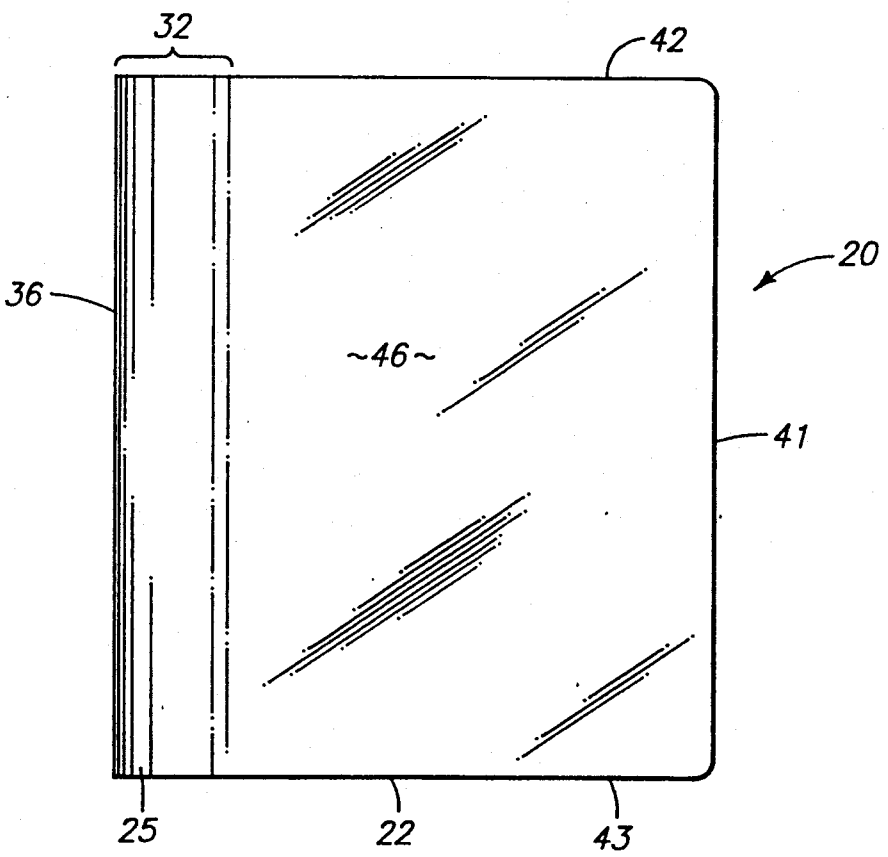
FIG. 16 is a bottom view of the stand of FIG. 12.
Figure 15:
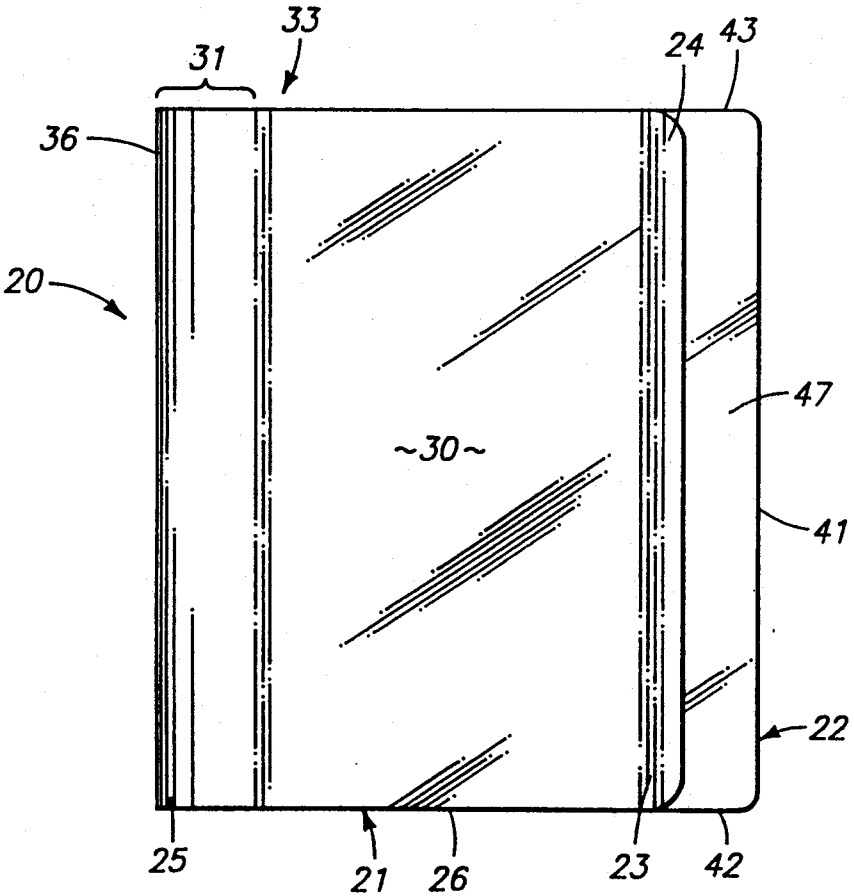
FIG. 15 is a top view of the stand of FIG. 12.

FIGS. 11–16 show the stand base 20 in an alternative or second mode of operation herein called the paper support mode of operation. FIGS. 11 and 12 show a piece of loose paper 80 held in an upright position upon stand base 20. In this mode of operation the stand base is positioned with the outer face 46 of the second panel upon a countertop or other supporting surface (not illustrated). The bottom edge of the loose paper rests against the first portion 31 of the support feature loop 25.

In compliance with the statute, the invention has been described in language necessarily limited in its ability to properly convey the conceptual nature of the invention. Because of this inherent limitation of language, it must be understood that the invention is not necessarily limited to the specific features described, since the means herein disclosed comprise merely preferred forms of putting the invention into effect. The invention is, therefore, claimed in any of its forms or modifications within the proper scope of the appended claims appropriately interpreted in accordance with the doctrine of equivalents.

I claim:

1. A book support stand for top bound books, having a plurality of leaves bound along the top thereof between first and second book covers, said book covers being hinged at cover hinges to a book spine formed by bound portions of said leaves and said covers; said support stand comprising:

a stand base; said stand base having:

a first panel;

a first edge stop connected to and extending upwardly from the first panel along a first edge thereof, to restrain said first book cover;

a second edge stop connected to and extending upwardly from the first panel along a second edge thereof in spaced, approximately parallel relationship to said first edge stop, to restrain said second book cover; and a detachable cover retainer structurally separate from the stand base for holding the book covers in an adjacent relationship near at least one cover hinge.

2. A book support stand according to claim 1 wherein the stand base includes a first panel support feature which extends to support the first panel above a supporting counter surface.

3. A book support stand according to claim 1 wherein the stand base includes a first panel support feature adjacent to the second edge stop which extends to support the first panel above a supporting counter surface.

4. A book support stand according to claim 1 and further comprising a second panel extending transversely from said first panel to form said second edge stop.

5. A book support stand for top bound books, having a plurality of leaves bound along the top thereof between first and second book covers, said book covers being hinged at cover hinges to a book spine formed by bound portions of said leaves and said covers; said support stand comprising:

a stand base; said stand base having:

a first panel;

a first edge stop connected to and extending upwardly from the first panel along a first edge thereof, to restrain said first book cover;

a second edge stop connected to and extending upwardly from the first panel along a second edge thereof in spaced, approximately parallel relationship to said first edge stop, to restrain said second book cover; and a detachable cover retainer for holding the book covers in an adjacent relationship near at least one cover hinge, wherein the cover retainer is a piece having first and second elongated bars joined by at least one end part.

6. A book support stand for top bound books, having a plurality of leaves bound along the top thereof between first and second book covers, said book covers being hinged at cover hinges to a book spine formed by bound portions of said leaves and said covers; said support stand comprising:

a stand base; said stand base having:

a first panel;

a first edge stop connected to and extending upwardly from the first panel along a first edge thereof, to restrain said first book cover;

a second edge stop connected to and extending upwardly from the first panel along a second edge thereof in spaced, approximately parallel relationship to said first edge stop, to restrain said second book cover; and a detachable cover retainer for holding the book covers in an adjacent relationship near at least one cover hinge, wherein the cover retainer is an annular piece having first and second elongated bars joined by end parts.

7. A book support stand for top bound books, having a plurality of leaves bound along the top thereof between first and second book covers, said book covers being hinged at cover hinges to a book spine formed by bound portions of said leaves and said covers; said support stand comprising:

a stand base; said stand base having:

a first panel;

a first edge stop connected to and extending upwardly from the first panel along a first edge thereof, to restrain said first book cover;

a second edge stop connected to and extending upwardly from the first panel along a second edge thereof in spaced, approximately parallel relationship to said first edge stop, to restrain said second book cover; and a detachable cover retainer for holding the book covers in an adjacent relationship near at least one cover hinge, wherein the cover retainer is an oblong hoop.

8. A book support stand according to claim 7 wherein the oblong hoop is made of non-stretchable material.

9. A combined book and paper support stand; said stand being operable in a first mode of operation as a book support and in a second mode of operation as a paper support; in said first mode of operation the stand holds top bound books, having a plurality of leaves bound along the top thereof between first and second book covers, said book covers being hinged at cover hinges to a book spine formed by bound portions of said leaves and said covers; said support stand comprising:

a stand base; said stand base having:

a first panel;

a first edge stop connected to and extending upwardly a first height from the first panel along a first edge thereof, to restrain said first book cover;

a second panel connected to and extending upwardly a second height from said first panel along a second edge thereof in spaced, approximately parallel relationship to said first edge stop, said second panel defining a second edge stop to restrain said second book cover, the second height being greater than the first height and sufficient to retain ones of said leaves between said second panel and said second book cover; and a detachable cover retainer for holding the book covers in an adjacent relationship near at least one cover hinge.

10. A book support stand according to claim 9 wherein the cover retainer is a piece having first and second elongated bars joined by at least one end part.

11. A book support stand according to claim 9 wherein the cover retainer is an annular piece having first and second elongated bars joined by end parts.

12. A book support stand according to claim 9 wherein the cover retainer is an oblong hoop.

13. A book support stand according to claim 9 wherein the cover retainer is an oblong hoop made of non-stretchable material.

14. A book support stand according to claim 9 wherein the stand base includes a first panel support feature which extends to support the first panel above a supporting counter surface.

15. A book support stand according to claim 9 wherein the stand base includes a first panel support feature adjacent to the second edge stop which extends to support the first panel above a supporting counter surface.

16. A book support stand according to claim 9 and further comprising a second panel extending transversely to said first panel to form said second edge stop.

17. A method for supporting top bound books, having a plurality of leaves bound along the top thereof between first and second book covers, said book covers being hinged at cover hinges to a book spine formed by bound portions of said leaves and said covers; the method comprising:

retaining the book covers in adjacent relationship by installing a detachable oblong cover retainer having first and second bars upon the book covers; said detachable oblong cover retainer being installed adjacent at least one of said cover hinges to hold the cover hinges in back to back relationship;

supporting a first book cover upon a first panel along a first edge stop against which the first book cover is supported;

supporting a second book cover upon said first panel along a second edge stop which is spaced in an approximately parallel relationship to said first edge stop and against which the second book cover is supported;

retaining ones of said leaves between said second panel and said second book cover.

18. A method for supporting top bound books, such as typing books, having a plurality of leaves bound along the top thereof between first and second book covers, said book covers being hinged at cover hinges to a book spine formed by bound portions of said leaves and said covers; the method comprising:

retaining the book covers in adjacent relationship by installing a detachable oblong annular retainer over the first and second covers; said detachable cover retainer being installed adjacent at least one of said cover hinges;

supporting a first book cover upon a first panel along a first edge stop against which the first book cover is supported;

supporting a second book cover upon said first panel along a second edge stop which is in spaced, approximately parallel relationship to said first edge stop, against which the second book cover is supported.

19. A method for supporting top bound books according to claim 18 wherein said retaining is accomplished by installing an oblong annular retainer over the first and second covers by sliding the retainer over the covers when the covers are folded together in face-to-face relationship.

20. A combined book and paper support stand; said stand being operable in a first mode of operation as a book support and in a second mode of operation as a paper support; in said first mode of operation the stand holds top bound books, having a plurality of leaves bound along the top thereof between first and second book covers, said book covers being hinged at cover hinges to a book spine formed by bound portions of said leaves and said covers; said support stand comprising:

a stand base; said stand base having:

a first panel;

a first edge stop connected to and extending upwardly from the first panel along a first edge thereof, to restrain said first book cover;

a second panel connected to and extending upwardly from said first panel along a second edge thereof in spaced, approximately parallel relationship to said first edge stop;

a second edge stop connected to and extending upwardly relative to the first panel along a second edge thereof in spaced relationship to said first edge stop, to restrain said second book cover; and a detachable cover retainer for holding the book covers in an adjacent relationship near at least one cover hinge, wherein the cover retainer is a piece having first and second elongated bars joined by at least one end part.

21. A combined book and paper support stand; said stand being operable in a first mode of operation as a book support and in a second mode of operation as a paper support; in said first mode of operation the stand holds top bound books, having a plurality of leaves bound along the top thereof between first and second book covers, said book covers being hinged at cover hinges to a book spine formed by bound portions of said leaves and said covers; said support stand comprising:

a stand base; said stand base having:

a first panel;

a first edge stop connected to and extending upwardly from the first panel along a first edge thereof, to restrain said first book cover;

a second panel connected to and extending upwardly from said first panel along a second edge thereof in spaced, approximately parallel relationship to said first edge stop;

a second edge stop connected to and extending upwardly relative to the first panel along a second edge thereof in spaced relationship to said first edge stop, to restrain said second book cover; and a detachable cover retainer for holding the book covers in an adjacent relationship near at least one cover hinge, wherein the cover retainer is an annular piece having first and second elongated bars joined by end parts.

22. A combined book and paper support stand; said stand being operable in a first mode of operation as a book support and in a second mode of operation as a paper support; in said first mode of operation the stand holds top bound books, having a plurality of leaves bound along the top thereof between first and second book covers, said book covers being hinged at cover hinges to a book spine formed by bound portions of said leaves and said covers; said support stand comprising:

a stand base; said stand base having:

a first panel;

a first edge stop connected to and extending upwardly from the first panel along a first edge thereof, to restrain said first book cover;

a second panel connected to and extending upwardly from said first panel along a second edge thereof in spaced, approximately parallel relationship to said first edge stop;

a second edge stop connected to and extending upwardly relative to the first panel along a second edge thereof in spaced relationship to said first edge stop, to restrain said second book cover; and a detachable cover retainer for holding the book covers in an adjacent relationship near at least one cover hinge, wherein the cover retainer is an oblong hoop.

23. A book support stand according to claim 22 wherein the oblong hoop is made of non-stretchable material.

* * * * *